US005320005A

United States Patent [19]

Hsiao

[11] Patent Number: 5,320,005

[45] Date of Patent: Jun. 14, 1994

[54] BICYCLE PEDAL CRANK DISMANTLING DEVICE

[76] Inventor: Chia-Yuan Hsiao, No. 4, Lane 11, Tze-Chiang St., Tu-Cheng City, Taipei Hsien, Taiwan

[21] Appl. No.: 147,483

[22] Filed: Nov. 5, 1993

[51] Int. Cl.[5] ..... B25B 23/00

[52] U.S. Cl. ..... 81/459; 81/437; 7/138

[58] Field of Search ..... 81/180.1, 437–439, 81/459; 7/100, 138, 170

[56] References Cited

U.S. PATENT DOCUMENTS 4,960,017 10/1990 Hsiao ..... 81/459

5,099,726 3/1992 Hsiao ..... 81/437 X

*Primary Examiner*—D. S. Meislin

*Attorney, Agent, or Firm*—Morton J. Rosenberg; David I. Klein

[57] ABSTRACT

A bicycle pedal crank dismantling device includes a locating member which comprises an inner thread through the length, an outer thread on one end for threading into the axle mounting hole of the crank to be dismantled, and a hexagon head on an opposite end; a driving rod which comprises a screw rod on one end threaded into the inner thread of the locating member for permitting the locating member to be turned upwards along the screw rod to carry the crank away from the bottom bracket axle, a hexagonal rod on an opposite end for turning socket head crank lock screws, and a hexagonal collar in the middle for turning with a spanner; and a socket retained to the hexagon rod of the driving rod by a clamp for turning hexagon head crank lock screws.

1 Claim, 8 Drawing Sheets

BICYCLE PEDAL CRANK DISMANTLING DEVICE

BACKGROUND OF THE INVENTION

The present invention relates to a device for dismantling the cranks from the bottom bracket bearing axle of a bicycle.

The procedure to dismantle the crank of a bicycle pedal from the bottom bracket bearing axle is complicated, and needs special tools. Before removing the crank, the crank lock screw must be dismantled first. As the crank lock screw may be a hexagon head cap screw or a socket head cap screw, different tools must be used for dismantling different types of crank lock screws.

SUMMARY OF THE INVENTION

The present invention eliminates the aforesaid problem. It is therefore the principal object of the present invention to provide a bicycle pedal crank dismantling device which allows the crank of a bicycle pedal to be conveniently dismounted from the bottom bracket bearing axle by using a single spanning device. It is another object of the present invention to provide a bicycle pedal crank dismantling device which is suitable for dismantling hexagon head crank lock screws as well as socket head crank lock screws.

According to the preferred embodiment, the bicycle pedal crank dismantling device is comprised of a locating member which comprises an inner thread through the length, an outer thread on one end for threading into the axle mounting hole of the crank to be dismantled, and a hexagon head on an opposite end; a driving rod which comprises a screw rod on one end threaded into the inner thread of the locating member for permitting the locating member to be turned upwards along the screw rod to carry the crank away from the bottom bracket axle, a hexagonal rod on an opposite end for turning socket head crank lock screws, and a hexagonal collar in the middle for turning with a spanner; and a socket retained to the hexagon rod of the driving rod by a clamp for turning hexagon head crank lock screws.

DETAILED DESCRIPTION OF THE PREFERRED EMBODIMENT

Figure 1:
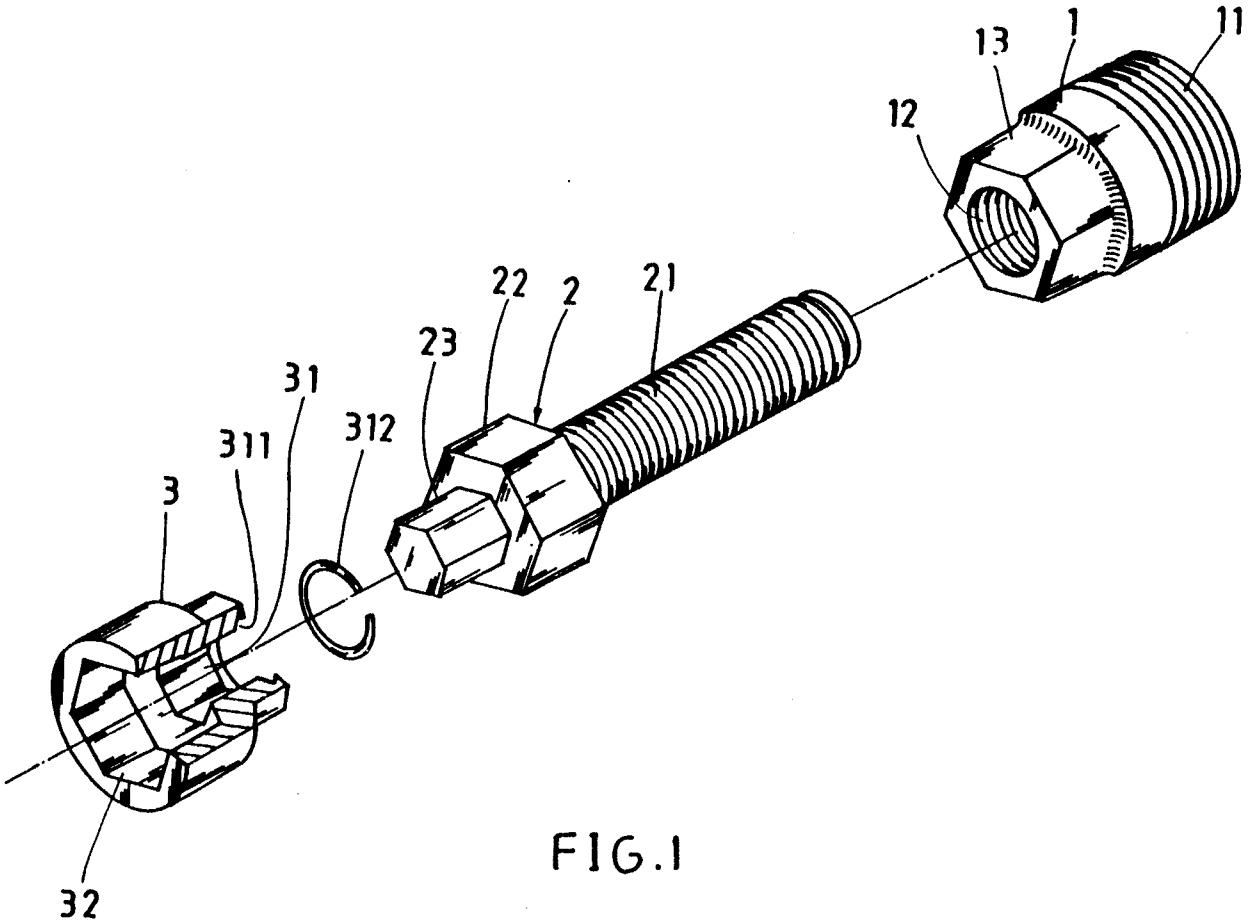
FIG. 1 is an exploded view of a bicycle pedal crank dismantling device according to the preferred embodiment of the present invention.

Referring to FIG. 1, a bicycle pedal crank dismantling device in accordance with the present invention is generally comprised of a locating member 1, a driving rod 2, and a socket 3. The locating member 1 comprises an inner thread 12 through the length, an outer thread 11 and a hexagon head 13 longitudinally aligned around the inner thread 12. The driving rod 2 is comprised of a screw rod 21 on one end threaded into the inner thread 12 of the locating member 1, a hexagonal rod 23 on an opposite end, and a hexagonal collar 22 disposed between the screw rod 21 and the hexagonal rod 23. The socket 3 is made of a stepped configuration having a small hexagonal hole 31 and a big hexagonal hole 32 longitudinally aligned through through the length. The hexagonal rod 23 of the driving rod 2 fits the small hexagonal hole 31 of the socket 3; the hexagonal collar 22 of the driving rod 2 fits the big hexagonal hole 32 of the socket 3. The socket 3 further comprises an annular groove 311 around the inside wall of the small hexagonal hole 31 thereof. A clamp 312 is fastened to the annular groove 311 to hold the socket 3 to the hexagonal rod 23 of the driving rod 2.

Figure 2:
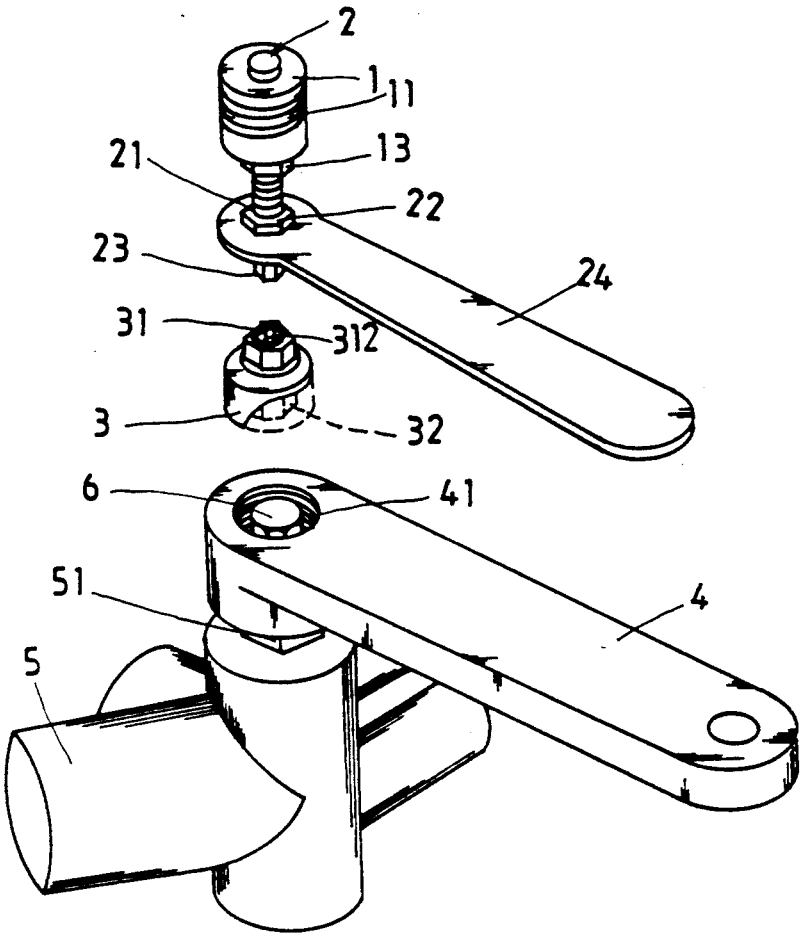
FIGS. 2, 3, and 4 illustrate a series of steps in dismantling a hexagon head crank lock screw according to the present invention.
Figure 3:
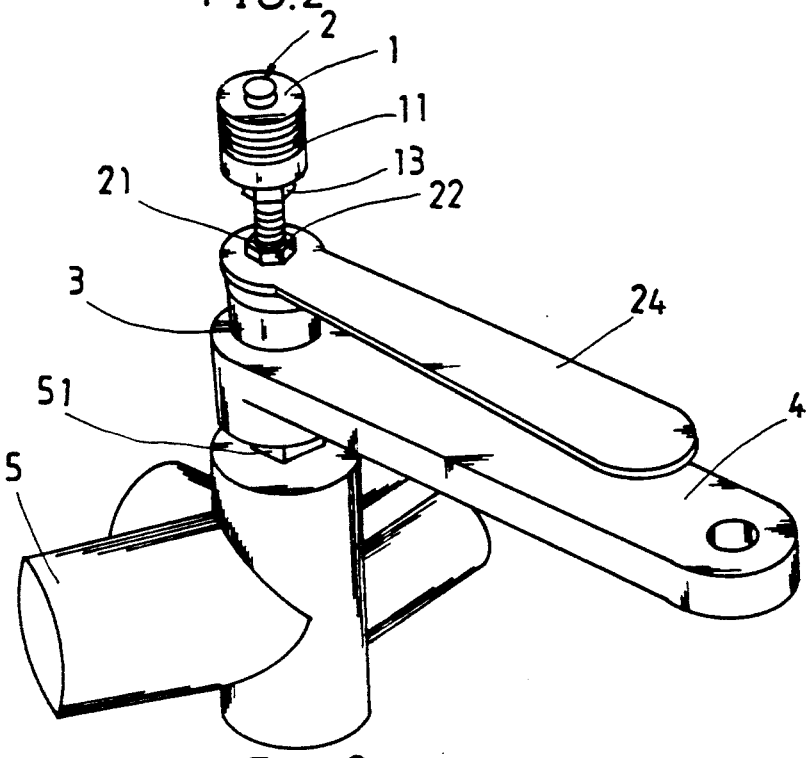
Figure 4:
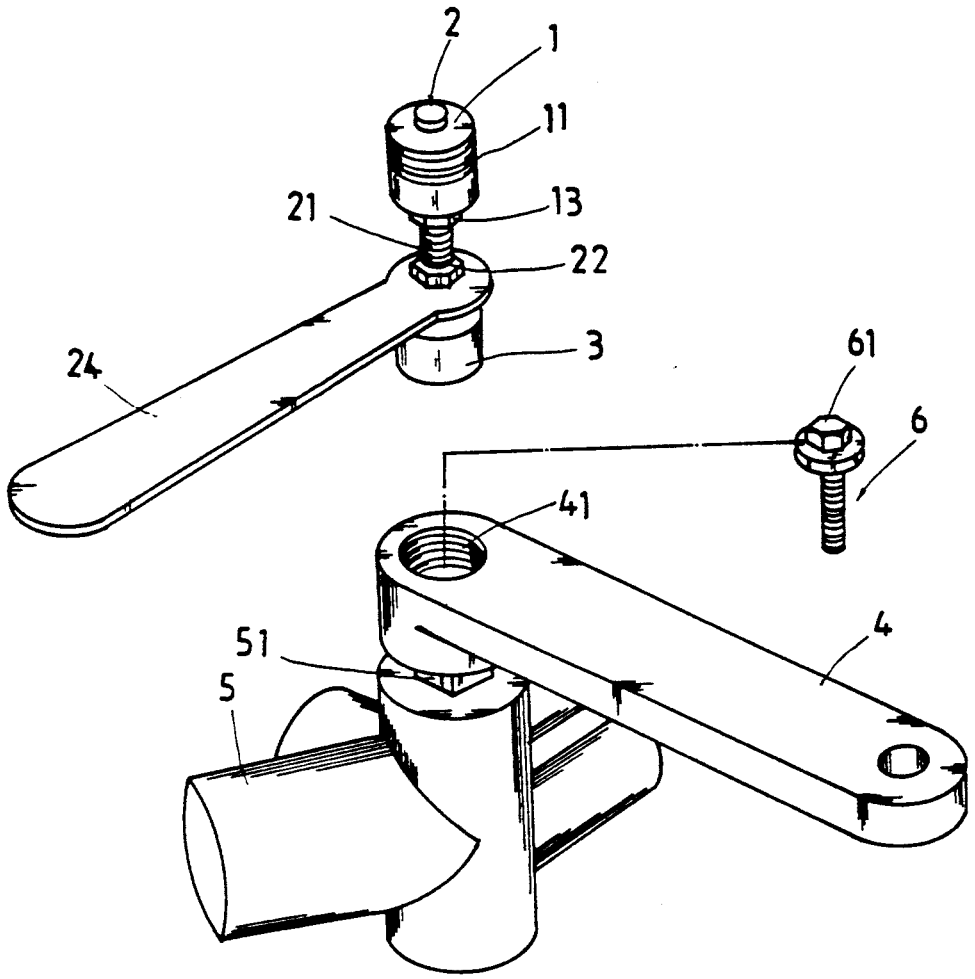

Referring to FIGS. 2, 3, and 4, a hexagon head crank lock screw 6 can be conveniently removed from the bicycle pedal crank assembly by turning the hexagonal collar 22 of the driving rod 2 with a spanner 24.

Figure 5:
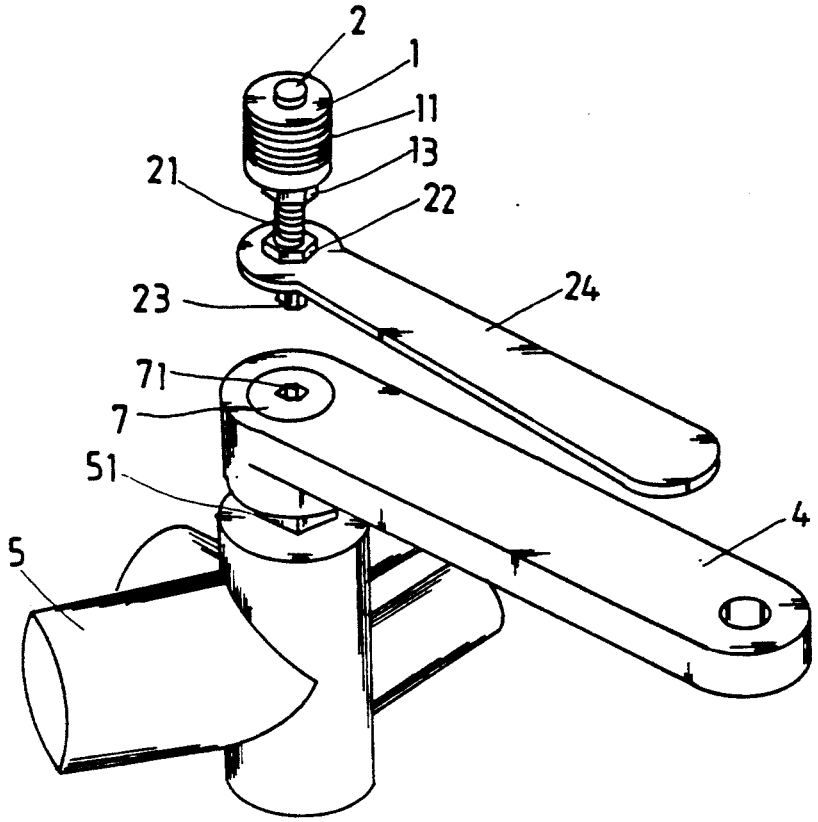
FIGS. 5, 6, and 7 illustrate a series of steps in dismantling a socket head crank lock screw according to the present invention.
Figure 6:
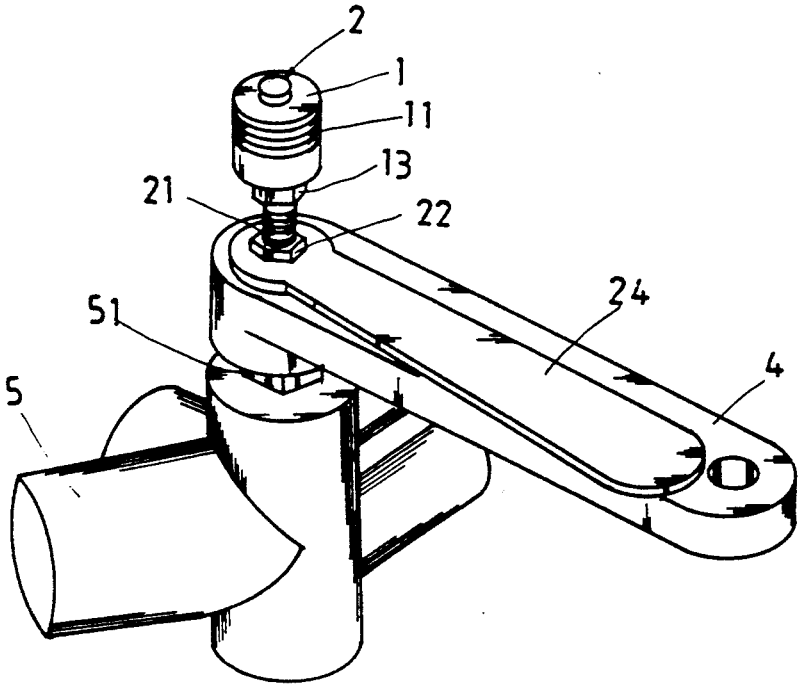
Figure 7:
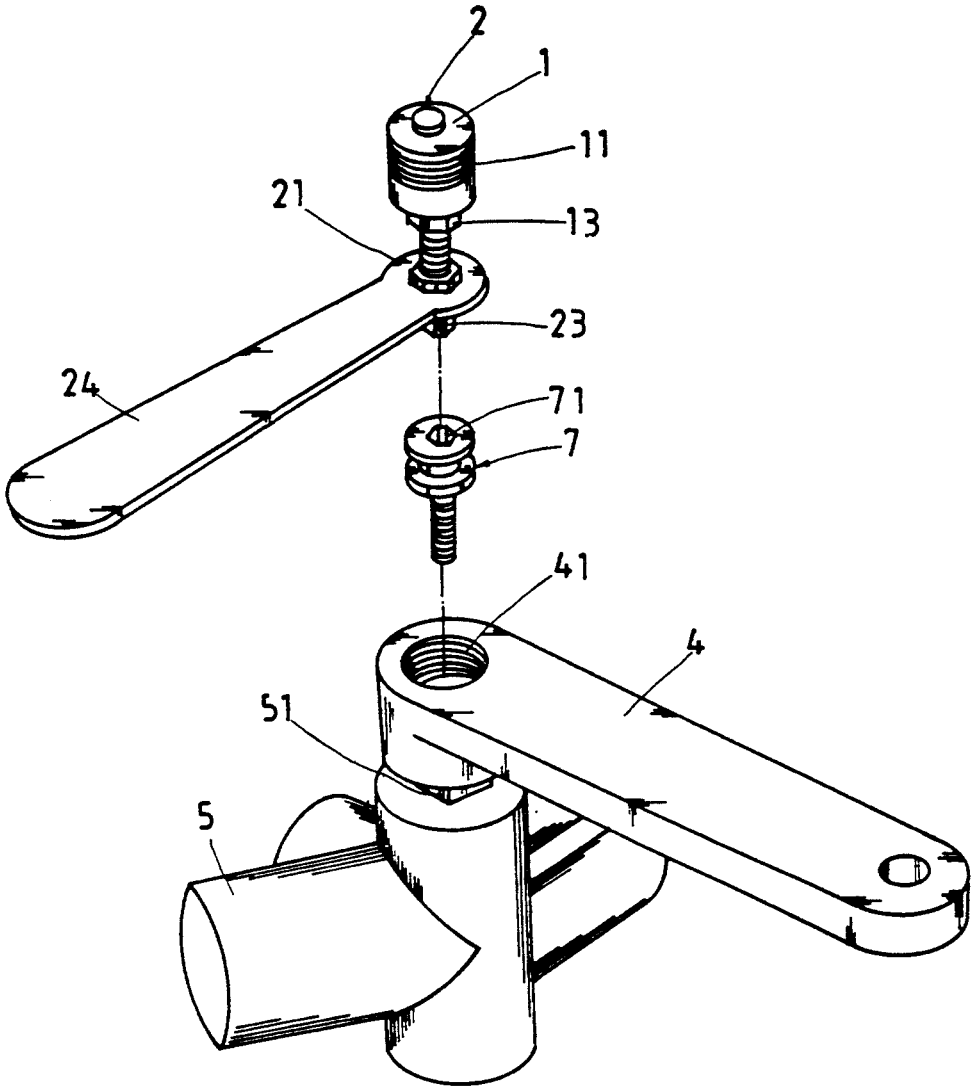
Figure 8:
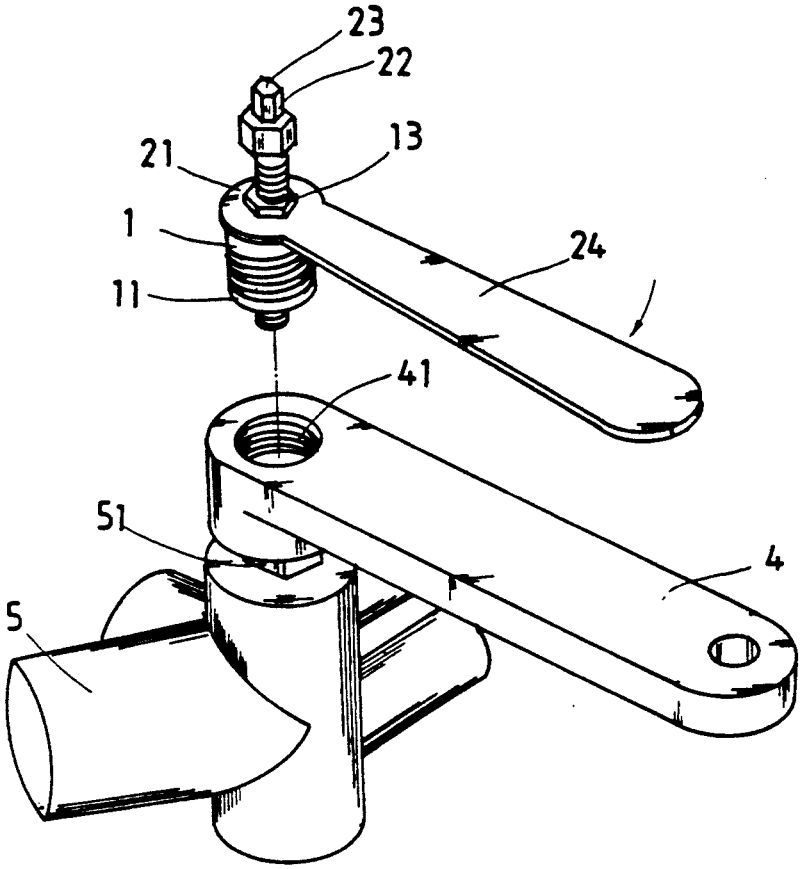
FIGS. 8, 9, 10, and 11 illustrate a series of steps in dismantling a bicycle pedal crank according to the present invention.
Figure 9:
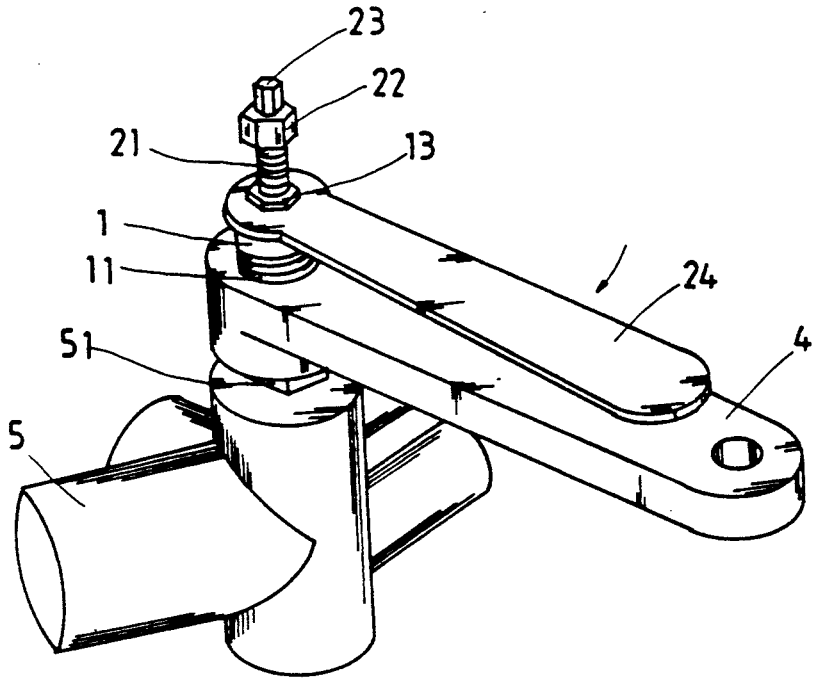
Figure 10:
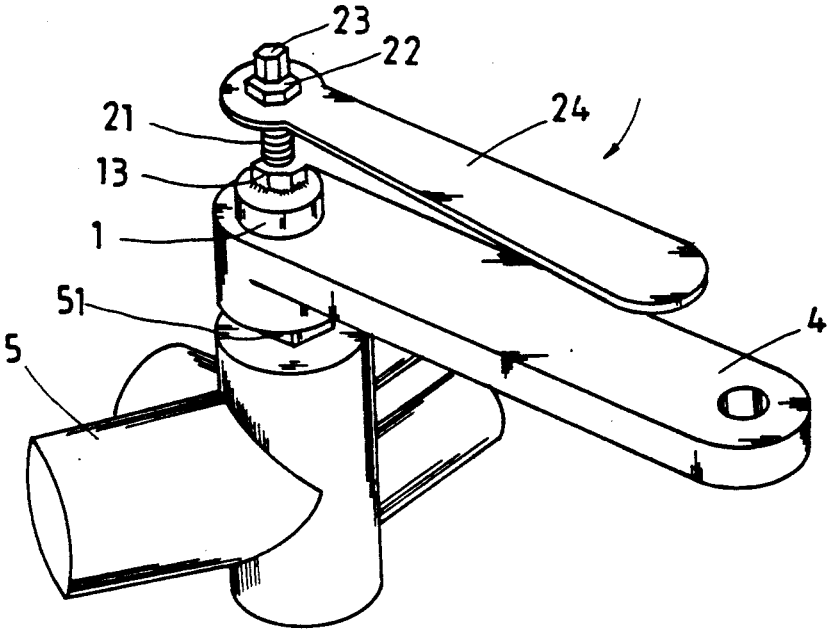
Figure 11:
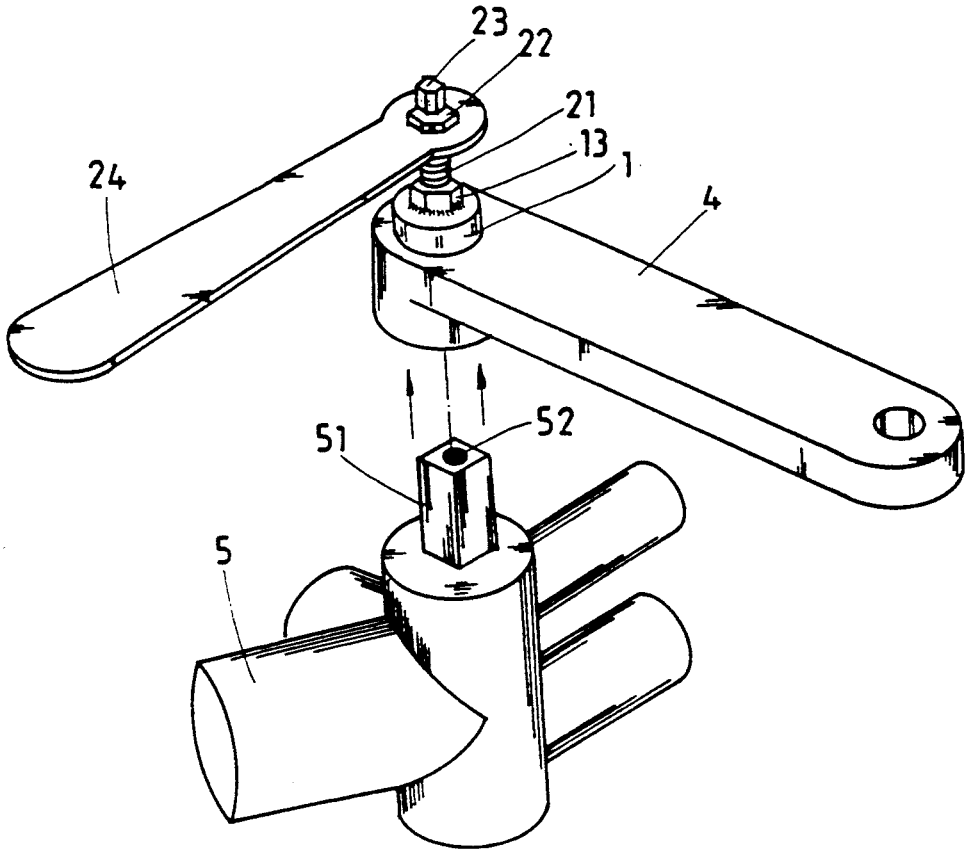
Figure 12:
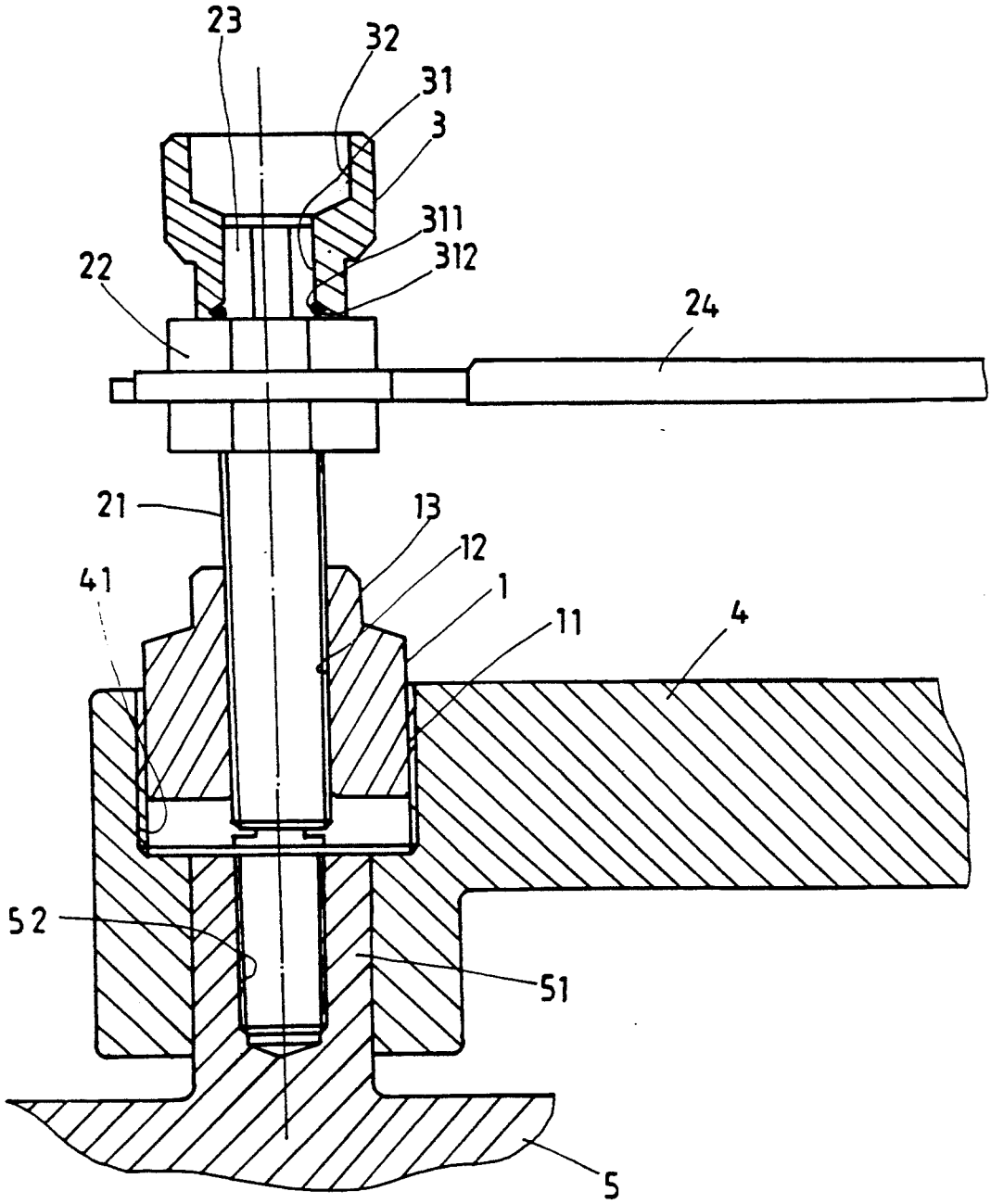
FIG. 12 is a sectional view showing the bicycle pedal crank dismantling device of FIG. 1 installed in position to dismantle the bicycle pedal crank.

Referring to FIGS. 5, 6, and 7, a socket head crank lock screw 7 can be conveniently removed from the bicycle pedal crank assembly by directly fitting the hexagonal rod 23 of the driving rod 2 into the hexagonal hole 71 of the socket head crank lock screw 7.

Referring to FIGS. 8, 9, 10, 11, and 12, the crank 4 can be conveniently removed from the axle 51 of the bottom bracket 5 by the pedal crank dismantling device after the crank lock screw was dismantled. The crank dismantling procedure is completed by: threading the outer thread 11 of the locating member 1 into the axle mounting screw hole 41 of the crank 4, then turning the screw rod 21 of the driving rod 2 into the inner thread 12 of the locating member 1 by a spanner 24 for permitting the screw rod 21 to stop against the axle 51 of the bottom bracket 5, and then continuously turning the driving rod 2 for permitting the locating member 1 to turn the crank 4 away from the axle 51.

What is claimed is:

1. A bicycle pedal crank dismantling device comprising:

a locating member which comprises an inner thread through the length, an outer thread and a hexagon head longitudinally aligned around said inner thread of said locating member, said outer thread of said locating member being for threading into axle mounting screw hole on the bicycle pedal crank to be dismantled;

a driving rod which comprises a screw rod on one end threaded into the inner thread of said locating member, a hexagonal rod on an opposite end, and a hexagonal collar disposed between the screw rod and hexagonal rod of said driving rod; and a socket which comprises a first hexagonal hole, into which said hexagonal rod of said driving rod fits, a second hexagonal hole in line with said first hexagonal hole, into which said hexagonal collar of said driving rod fits, and a clamp fastened to an annular groove inside said first hexagonal hole to retain said socket to said driving rod.

* * * * *